United States Patent [19]

Lacy

[11] Patent Number: 4,599,610

[45] Date of Patent: Jul. 8, 1986

[54] OVERLAYING INFORMATION ON A VIDEO DISPLAY

[75] Inventor: Robert H. Lacy, Bartlesville, Okla.

[73] Assignee: Phillips Petroleum Company, Bartlesville, Okla.

[21] Appl. No.: 591,760

[22] Filed: Mar. 21, 1984

[51] Int. Cl.[4] ..... G09G 1/06

[52] U.S. Cl. ..... 340/721; 340/709; 340/734; 340/724

[58] Field of Search ..... 340/709, 734, 721, 723, 340/724

[56] References Cited

U.S. PATENT DOCUMENTS

| | | | |
|---|---|---|---|
| Re. 31,200 | 4/1983 | Sukonick et al. | 340/724 |
| 3,872,461 | 3/1975 | Jarosik et al. | 340/723 X |
| 4,070,710 | 1/1978 | Sukonick et al. | 340/724 X |
| 4,136,359 | 1/1979 | Wozniak | 358/17 |
| 4,146,879 | 3/1979 | Nicholson et al. | 340/734 |
| 4,149,148 | 4/1979 | Miller et al. | 340/724 X |
| 4,165,506 | 8/1979 | Brands et al. | 340/721 X |
| 4,200,869 | 4/1980 | Murayama et al. | 340/723 |
| 4,247,843 | 1/1981 | Miller et al. | 340/721 X |
| 4,258,362 | 3/1981 | Brown et al. | 343/7.3 |
| 4,302,755 | 11/1981 | Pisani et al. | 340/734 |
| 4,314,357 | 2/1982 | Kimura et al. | 340/735 X |
| 4,317,114 | 2/1982 | Walker | 340/721 |
| 4,454,593 | 6/1984 | Fleming et al. | 340/723 X |
| 4,498,079 | 2/1985 | Ghosh et al. | 340/721 X |
| 4,527,155 | 7/1985 | Yamaki et al. | 340/721 X |
| 4,542,376 | 9/1985 | Bass et al. | 340/723 X |

*Primary Examiner*—Gerald L. Brigance
*Assistant Examiner*—Vincent P. Kovalick
*Attorney, Agent, or Firm*—French and Doescher

[57] ABSTRACT

A normal video signal and an overlay video signal are combined by supplying the normal video signal to the base of a first emitter follower transistor while the overlay video signal is supplied to the base of a second emitter follower transistor. The two transistors are biased such that the first transistor is at a slightly lower voltage than the second (overlay) transistor and is reversed biased (off) any time data is available from the overlay video signal.

5 Claims, 7 Drawing Figures

OVERLAYING INFORMATION ON A VIDEO DISPLAY

This invention relates to displaying information on a video display. In one aspect, this invention relates to method and apparatus for displaying at least two different displays of information on a video display.

A conventional system utilizing a video display (typically a CRT) is illustrated in FIG. 1. A computer 11 is interfaced to the display generator 12. In general, the display generator 12 takes data supplied from the computer 11 and converts the data into an EIA Standard RS-170 format which can be utilized to drive the CRT 14. EIA Standard RS-170 defines a method for combining the sync, blanking and video signals required by a CRT onto a single coaxial cable. The thus combined signal is generally referred to as a composite video waveform. For a color system, only the green channel contains the sync signal. Additional coaxial cables are required for the red and blue video signals.

The display generator 12 typically contains at least interfacing circuitry, a refresh memory, a character generator and video processing circuitry. In many applications, character addressing is used for the display generator 12. In character addressing, each location (address) in the refresh memory corresponds to one character on a CRT screen rather than one dot. A character will generally be made up of an array of dots on a CRT screen. A typical arrangement is a matrix of 7 dots×10 dots to form a character. This yields 70 dots per character which may be "on" or "off" in any combination to form any particular character.

The refresh memory location corresponding to any particular CRT screen position may contain as little as a 6 to 8 bit code (typically ASCII) specifying which character (of a set) is desired at that position. Thus, the 70 dots in the character on the screen are compressed into 6 to 8 bits in the refresh memory. Character addressing thus restricts the amount of information which can be displayed on the CRT and also the location at which the data can be displayed, but character addressing does have several advantages such as the reduced size of the refresh memory required as opposed to a system in which dot addressing is utilized.

In many applications it is frequently desired to display two different sets of information such as a graphical representation and alphanumeric information. An example of such an application is process control where it may be desired to display a graphical representation of a process and periodically add alphanumeric information for process conditions.

For the system illustrated in FIG. 1, alphanumeric data must be placed on the CRT in such a way as not to overwrite any graphical display characters or the graphical display characters will be destroyed. This occurs because, if an alphanumeric character is written over a graphical character in a character addressed video display system, the entire graphical character is destroyed even though only a few of the 70 dots in the character may be used for the alphanumeric character.

It would be desirable to overlay or superimpose the alphanumeric character over the graphical character in such a manner that the alphanumeric character may be read but the graphical character, and thus the continuity of the graphical display, is not destroyed. One method which has been suggested for accomplishing this is as illustrated in U.S. Pat. No. 4,200,869. The solution of U.S. Pat. No. 4,200,869 is very broadly illustrated in a block diagram format in FIG. 2.

Referring now to FIG. 2, computer 11 is again interfaced to the display generator 12. However, a second display generator 16, which is addressed in parallel with the display generator 12, is added in the teachings of U.S. Pat. No. 4,200,869. Parallel addressing refers to addressing such that the video signals of display generators 12 and 16 would be applied to the same dot on the CRT 14. The output from both the display generator 12 and display generator 16 are provided to the OR gate 18 with the output of the OR gate 18 being utilized to drive the CRT 14.

The display generator 12 may be utilized to generate the video signal required for the graphical display. In like manner, the display generator 16 may be utilized to generate the video signal required for the alphanumeric information. These two signals are combined and provided to the CRT 14. The result is an overlay of the graphical display and the alphanumeric information.

One of the problems with the system illustrated in FIG. 2 is illustrated in FIG. 3. Referring now to FIG. 3, assume that the graphical character is a solid block. Also, assume that the alphanumeric word is the word BAD. Because no priority can be assigned in the system of FIG. 2, the letter A would completely disappear. Thus, the use of an OR gate to combine the two video signals is feasible only where neither video signal utilizes a major number of the dots in a character on a CRT screen.

FIG. 4 illustrates a more desired overlay of the graphical and alphanumeric data. Referring now to FIG. 4, it can be seen that, in the more desired situation, the overlay video (alphanumeric) has been made brighter than the graphical display. This results in a true overlay in that the alphanumeric word can be read and the graphical display remains undisturbed except to the extent of the dots required to form the letter A. Other dots remaining in the character block utilized to form the letter A can continue to be used for the graphical display.

It is thus an object of this invention to provide method and apparatus for displaying alphanumeric and graphical data on a character oriented video display in such a manner that a priority is assigned to the alphanumeric data such that the alphanumeric data can be seen as illustrated in FIG. 4.

As used herein, the term "overlay video signal" refers to the video signal which is given priority and the term "normal video signal " refers to the video signal which is not given priority. In most cases the normal video signal will produce a graphical display and the overlay video signal will produce an alphanumeric display. Thus the present invention is sometimes described herein in terms of displaying both graphical and alphanumeric information. However, the invention is not limited to the display of such information and could be utilized to display other types of information or could be utilized to display two sets of the same type of information (such as graphical) where it is desired to give priority to one set.

In accordance with the present invention, two transistors, configured as emitter followers and sharing a common emitter resistor, are utilized to combine the normal video signal and the overlay video signal in such a manner that the results illustrated in FIG. 4 are achieved. Essentially, the normal video signal is supplied to the base of a first emitter follower transistor while the overlay video signal is supplied to the base of a second emitter follower transistor. The two transistors are biased such that the first transistor is at a slightly lower voltage than the second (overlay) transistor and is reversed biased (off) any time data is available from the overlay video signal. Thus, the selection of the video signals is accomplished based on the video signals and very fast and clean switching is provided. Also, the visibility of the overlay video signal is improved by using a higher voltage for the overlay video signal than for the normal video signal.

Other objects and advantages of the invention will be apparent from the foregoing brief description of the invention and the claims as well as from the description of the drawings, some of which have been previously described. All of the drawings are briefly described as follows:

Figure 1:
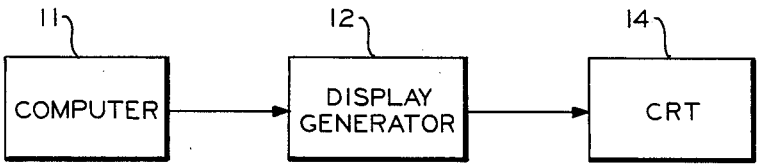
FIG. 1 is a diagrammatic illustration of a conventional system for displaying data provided by a computer on a CRT using one display generator.
Figure 2:
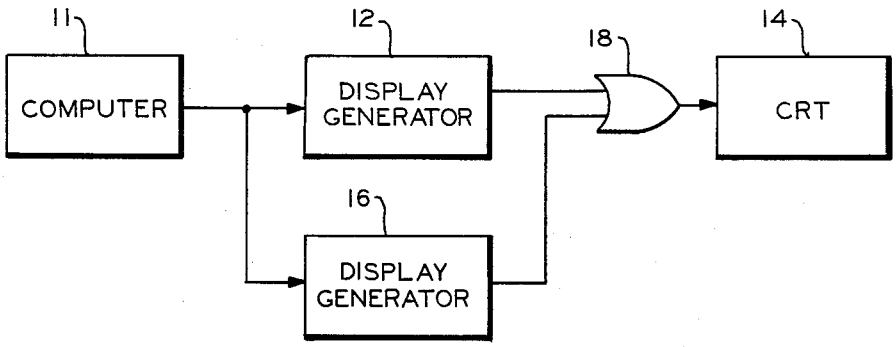
FIG. 2 is a diagrammatic illustration of the use of two display generators to provide information from a computer to a video display.
Figure 3:
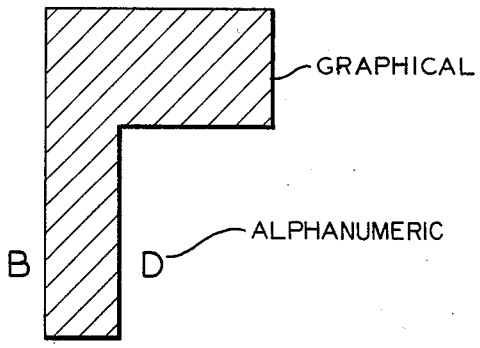
FIG. 3 is an illustration of a problem which may occur using the display system of FIG. 2.
Figure 4:
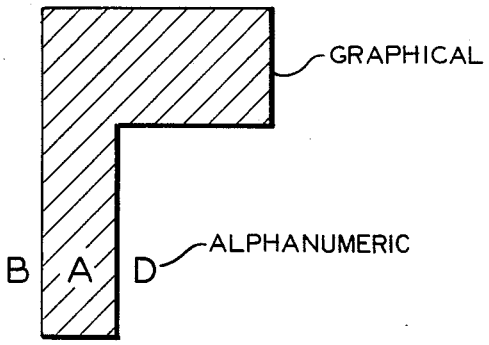
FIG. 4 is an illustration of a desired display of both graphical and alphanumeric data.

The invention is described in terms of the use of two display generators for the sake of convenience. However, the invention is applicable to combining the video signals from more than two display generators if desired.

The invention is also described in terms of specific electronic components. However, the invention is applicable to different electronic circuit configurations which carry out the purpose of the present invention and is also applicable to different circuit components which are supplied by a plurality of vendors.

Referring now to FIG. 5, there is again illustrated the host computer 11, display generators 12 and 16 and the CRT 14. Any suitable computer and CRT can be utilized. The compouter and CRT utilized in the particular system to which the present invention was applied were the Motorola MC6800 MPV and Aydia 8830 Color CRT.

The display generators 12 and 16 may be any desired display generators. Display generators are well known in the art and, as has previously been stated, will generally contain an interface to the computer 11, a refresh memory, a character generator which may be either a random access memory or an erasable programmable read-only memory and other video processing circuitry. Since the present invention is concerned with combining of video signals and not with generation of the video signals, the display generators 12 and 16 will not be more fully described hereinafter.

Display generator 12 provides a normal video signal 21 to the base of the transistor 23 which is an NPN transistor configured as an emitter follower. The normal video signal 21 may be a composite video waveform containing sync, blanking and video signals, as previously described, or may be a serial video waveform containing only video signals. If the video waveform 21 is a serial video waveform, then the blanking and sync signals would typically be added before a signal is provided to the CRT 14 but since the addition of such signals plays no part in the description of the present invention, such addition is not illustrated.

The overlay video signal 24 is provided from the display generator 16 to the base of the transistor 26 which, like transistor 23, is an NPN transistor configured as an emitter follower. The video waveform 24 will not contain sync signals since these signals are provided by the "normal" channel and will thus be serial video only.

The video signal 21 will be a stream of serial data. The normal video signal 21 is actually provided to the base of transistor 23 by "modulating" the voltage at node 27 which is established by the bias resistors 28 and 29 in conjunction with the supply voltage 32. Since the driving devices in display generators are open collector devices, the voltage at node 22 will either be essentially zero when the normal video signal 21 is not in a state which will cause a dot on the CRT to be illuminated (referred to hereinaftre as "low") or will be at a voltage level determined by the magnitude of the supply voltage and the values of the bias resistors 28 and 29 if the video signal is in a state which will cause a dot on the CRT to be illuminated (referred to hereinafter as "high"). Thus, either an essentially zero voltage is applied to the base of the transistor 23 or a voltage level greater than zero but less than 5 volts is applied.

In like manner, the overlay video signal 24 modulates the voltage at node 34. Again, the voltage at node 34 will either be essentially zero when the data in the overlay video signal is low or will be at some positive voltage level determined by the magnitude of the supply voltage 32 and the value of the bias resistors 37 and 38 if the data in the overlay video signal is high. Thus, as with transistor 23, the voltage applied to the base of the transistor 26 will either be essentially zero or will be a positive voltage.

Transistors 23 and 26 share a common emitter resistor 41. The emitters of transistors 23 and 26 are also tied to the CRT 14 through the coupling resistor 44.

For almost all CRT's, the screen is filled beginning at the upper left hand corner and continuing horizontally across the screen to the upper right hand corner on a dot-by-dot basis. The electron beam then goes to the left-hand side of the screen on the second row during a blanking pulse and the second row is filled. This process continues until the electron beam reaches the lower right-hand corner of the screen at which time the vertical sync pulse occurs causing the electron beam to return to the upper left-hand corner of the screen.

When the screen is being filled, the normal video signal 21 will be at a high value if a first dot is to be illuminated or will be at a low value if the first dot is to be left off. In like manner, at the same time, overlay video signal 24 will be at a high level if the first dot is to be illuminated and will be at a low level if the first dot is to be left off. Priority is assigned to overlay video signal 24 by the circuitry illustrated in FIG. 5 as will be more fully described hereinafter. Thus, if the normal video signal 21 would require the first dot to be illuminated and overlay video signal 24 would require the first dot to be illuminated, then the first dot will be illuminated in response to overlay video signal 24. The manner in which this is accomplished is illustrated in FIG. 6 where specific voltage and resistance values have been assigned for the sake of illustration.

Figure 6:
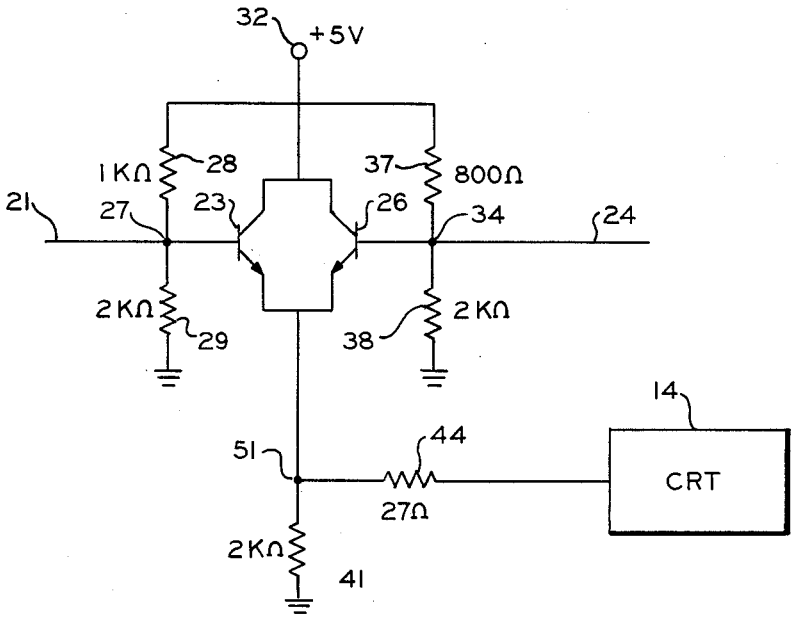
FIG. 6 is an illustration of part of the circuit of FIG. 5 with specific resistance and voltage values.

Referring now to FIG. 6, for the resistor and voltage values illustrated in FIG. 6 and the particular system to which the present invention was applied, node 27 will have a voltage level of about 3.33 volts if the normal video signal 21 is high and will have a voltage level of essentially zero if the normal video signal 21 is low. Node 34 will have a voltage level of about 3.57 volts if the overlay video signal 24 is high and will have a voltage level of essentially zero if the overlay video signal 24 is low.

If, for a particular point (dot 1) on the CRT screen, video signal 21 is high and video signal 24 is low, then transistor 23 will be turned on and transistor 26 will be reversed biased or off. Due to the typical 0.6 volt base emitter drop, the voltage level at node 51 will be about 2.73 volts. Thus, dot 1 will be illuminated in response to video signal 21.

The opposite situation would be if video signal 21 is low for dot 1 and video signal 24 is high for dot 1. Transistor 26 would be turned on and transistor 23 would be reversed biased or off. The voltage at node 51 would be about 2.97 volts and dot 1 would be illuminated in response to video signal 24. It is noted that the voltage produced by video signal 24 at node 51 is higher than the voltage produced by video signal 21. This results in dot 1 being illuminated at a higher intensity in response to video signal 24 which enables an alphanumeric character to be seen even if all dots around the alphanumeric character have also been illuminated for the graphical display produced by signal 21.

If both video signal 21 and video signal 24 are high for dot 1, then the voltage at the base of transistor 23 will be about 3.33 volts and the voltage at the base of transistor 26 will be about 3.57 volts. This results in transistor 26 being turned on but transistor 23 will again be reversed biased or turned off even though there is a voltage present at the base of transistor 23 because of the higher voltage present at the base of transistor 26. Thus, the voltage at node 51 will be controlled by video signal 24 even if video signal 21 is also high. This results in a priority being assigned to video signal 24.

If both video signals 21 and 24 are low, then the voltage at node 51 will be essentially zero and dot 1 will not be illuminated.

Figure 5:
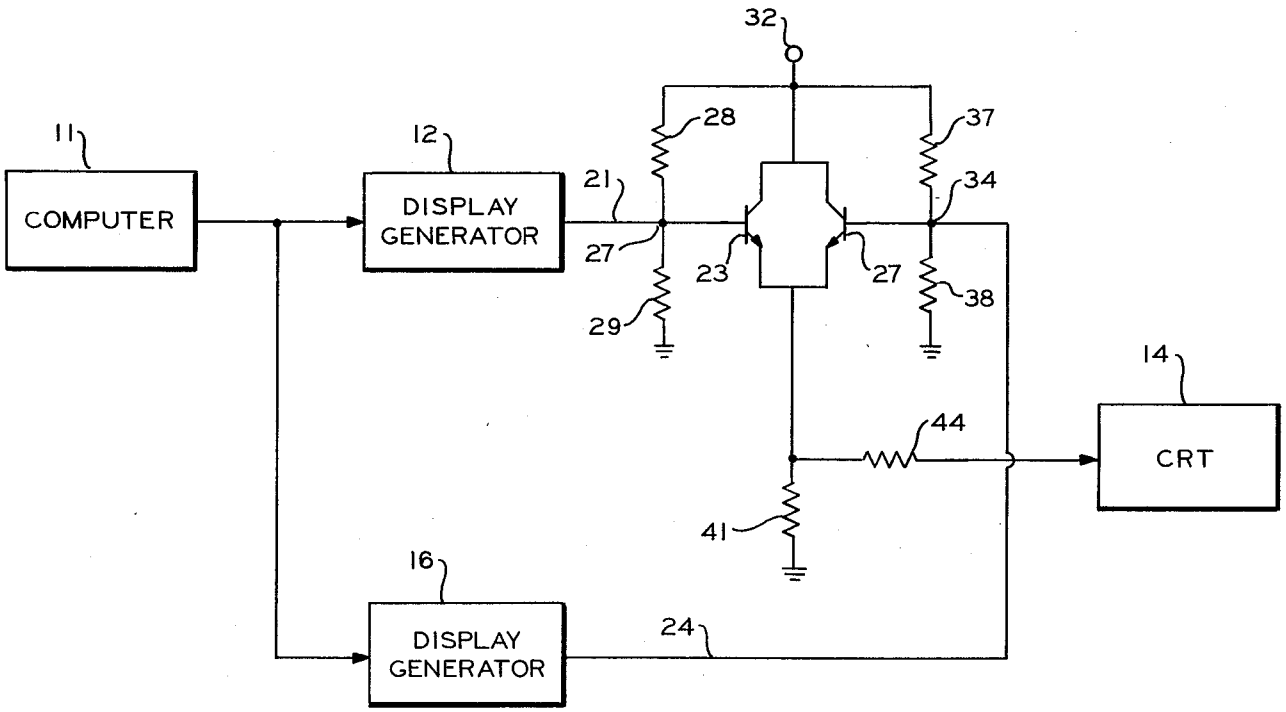
FIG. 5 is an illustration of the circuitry used in accordance with the present invention to combine a normal video signal and an overlay video signal for a black and white display.

In summary with respect to FIGS. 5 and 6, for a black and white display, the overlay video signal is given priority on a dot-by-dot basis. Also, the intensity of the characters produced by the overlay video signal are enhanced with respect to the display produced by the normal video signal which aids in viewing the alphanumeric characters even if the alphanumeric characters are directly superimposed over a portion of the graphical display.

Figure 7:
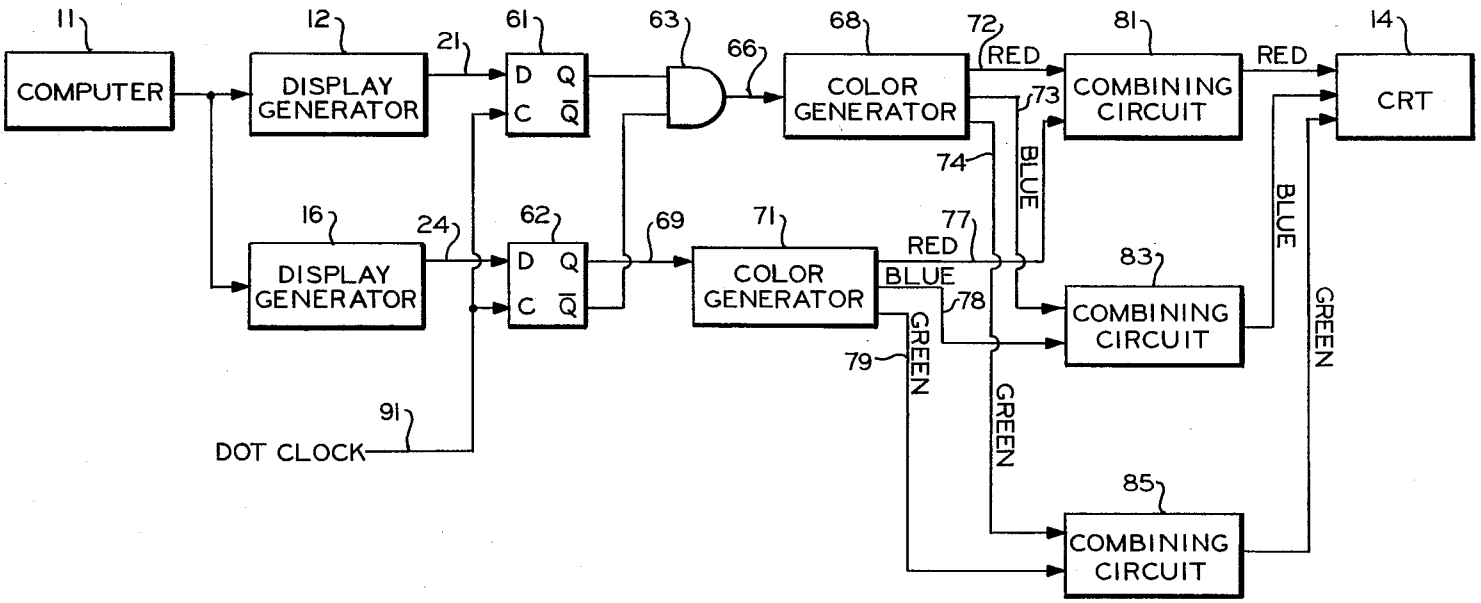
FIG. 7 is an illustration of circuitry which may be utilized in accordance with the present invention to combine the normal video signal and overlay video signal for a color system.

A color system is illustrated in FIG. 7. Computer 11 again addresses the display generators 12 and 16 in parallel. However, video signals 21 and 24 are provided to the D input of flip-flops 61 and 62, respectively, instead of being provided directly to the combining circuitry as illustrated in FIG. 5. The use of the flip-flops 61 and 62 as well as the AND gate 63 will be described more fully hereinafter.

Essentially, video signal 21 is applied as video signal 66 to the color generator 68. In like manner, video signal 24 is applied as video signal 69 to the color generator 71.

The color generator 68 and 71 are conventional and are essentially programmable read-only memories with associated registers. Additional information is supplied from the refresh memory portion of the display generators for color selection. In response to signal 66, the color generator 68 provides three output video signals 72–74 (red, blue and green, respectively). In like manner, in response to video signal 69, the color generator 71 provides three output video signals 77–79 (red, blue and green, respectively). The two red signals are provided to the combining circuit 81 which is the same as the combining circuit illustrated in FIGS. 5 and 6. In like manner, the blue signals are provided to the combining circuit 83 and the green signals are provided to the combining circuit 85.

A single video signal is provided from each combining circuit to the red, blue or green gun of the color CRT 14.

As was the case for the combining circuits illustrated in FIGS. 5 and 6, video signals 77, 78 and 79 are given priority. However, for a color system, both the red and green signals from color generator 68 may be high for a first dot to produce a yellow color on the CRT for the first dot. For the same dot, only the red signal from the color generator 71 may be high. To give priority to only the red signal 77 with respect to the red signal 72 would result in the wrong color on the CRT since green would be added in response to signal 74 because signal 79 is low. This is avoided by disabling all color signals from the color generator 78 when video signal 24 goes high indicating that alphanumeric data is available for the first dot. This is accomplished using flip-flops 61 and 62 and the AND gate 63.

The dot clock 91, which is the master timing signal for the generation of the video signals, is provided to the clock input of both flip-flops 61 and 62. Thus, flip-flops 61 and 62 may change state each time the digital value of the video signals 21 or 24 may change. If video signal 21 is high for a first dot and video signal 24 is low, then the Q not output from flip-flop 62, which is provided as a first input to the AND gate 63, will be high. In like manner, the Q output from flip-flop 61 will be high and signal 66 will be high. Thus, signal 66 will have the same magnitude as signal 21.

If the video signal 21 is low for a first dot and the video signal 24 is high, then signal 66 will be low and signal 69 will be high.

The disabling effect occurs when both signals 21 and 24 are high for a first dot. The Q output from flip-flop 61 will be high but the Q not output from flip-flop 62 will be low. Thus, signal 66 will be low which effectively disables all normal video signals 72, 73 and 74 for the first dot. Signal 69 will be high and the first dot will be illuminated in response to signal 69. Thus, an override is provided for the overlay video signal and also the correct color will be visible on the CRT screen for the first dot.

The invention has been described in terms of a preferred embodiment in which a detailed schematic has been set forth for the combining circuitry. Circuit values have been given and the transistors 23 and 27 could be 2N3904s. The flip-flops could be 74LS74 and the AND gate could be 74LS08.

While the invention has been described in terms of the presently preferred embodiment, reasonable variations and modifications are possible by those skilled in the art and such variations and modifications are within the scope of the described invention and the appended claims.

That which is claimed is:

1. Apparatus comprising:

a video display;

a first transistor;

a second transistor;

means for electrically connecting the emitter of said first transistor and said second transistor to ground through a first resistor;

means for electrically connecting the collector of said first transistor to the collector of said second transistor;

means for generating a first video signal and for supplying said first video signal to the base of said first transistor, wherein the voltage at the base of said first transistor is at a first voltage level when it is desired to illuminate a first dot on the screen of said video display in response to said first video signal and is at a second voltage level, which is lower than said first voltage level, when it is not desired to illuminate said first dot in response to said first video signal;

means for generating a second video signal and for supplying said second video signal to the base of said second transistor, wherein the voltage at the base of said second transistor is at a third voltage level when it is desired to illuminate said first dot in response to said second video signal and is at a fourth voltage level, which is lower than said third voltage level, when it is not desired to illuminate said first dot in response to said second video signal and wherein said third voltage level is higher than said first voltage level; and means for supplying the voltage at the emitter of said first transistor and said second transistor as the video signal to said video display.

2. Apparatus in accordance with claim 1 wherein said means for generating said first video signal and for supplying said first video signal to the base of said first transistor and said means for generating said second video signal and for supplying said second video signal to the base of said second transistor comprises:

means for electrically connecting the base of said first transistor to a supply voltage through a second resistor;

means for electrically connecting the base of said first transistor to ground through a third resistor, wherein a first node is formed by the electrical connection between said second resistor and said third resistor;

a first display generator having an open collector driver;

means for electrically connecting the open collector driver of said first display generator to said first node to thereby supply said first video signal to the base of said transistor;

means for electrically connecting the base of said second transistor to said supply voltage through a fourth resistor;

means for electrically connecting the base of said second transistor to ground through a fifth resistor, wherein a second node is formed by the electrical connection between said fourth resistor and said fifth resistor and wherein the resistance value of said fourth resistor is lower than the resistance value of said second resistor;

a second display generator having an open collector driver;

means for electrically connecting the open collector driver of said second display generator to said second node to thereby supply said second video signal to the base of said second transistor; and means for electrically connecting the collector of said first transistor and the collector of said second transistor to said positive supply voltage.

3. Apparatus comprising:

a first display generator;

a second display generator;

a first flip-flop having a data input, a clock input, a Q output and a Q not output;

a second flip-flop having a data input, a clock input, a Q output and a Q not output;

means for supplying a first video signal from said first display generator to the data input of said first flip-flop;

means for supplying a second video signal from said second display generator to the data input of said second flip-flop;

means for providing the dot clock utilized to generate said first video signal and said second video signal to the clock input of said first flip-flop and said second flip-flop;

an AND gate;

means for electrically connecting the Q output of said first flip-flop to a first input of said AND gate;

means for electrically connecting the Q not output of said second flip-flop to a second input of said AND gate;

a first color generator;

a second color generator;

means for providing the output from said AND gate as a first input video signal to said first color generator;

means for providing the Q output from said second flip-flop as a second input video signal to said second color generator, wherein said first input video signal has a voltage level equal to said first video signal if said second video signal has a voltage level of essentially zero and has a voltage level of essentially zero if said second video signal has a positive voltage level, wherein said first color generator provides a first red video signal, a first blue video signal and a first green video signal in response to said first input video signal and wherein said second color generator provides a second red video signal, a second blue video signal and a second green video signal in response to said second input video signal;

a video display having a red gun, a blue gun and a green gun;

a first transistor;

a second transistor;

means for electrically connecting the emitter of said first transistor and said second transistor to ground through a first resistor;

means for electrically connecting the collector of said first transistor to the collector of said second transistor;

means for supplying said first red video signal to the base of said first transistor, wherein the voltage at the base of said first transistor is at a first voltage level when it is desired to illuminate a first dot on the screen of said video display in response to said first red video signal and is at a second voltage level, which is lower than said first voltage level, when it is not desired to illuminated said first dot in response to said first red video signal;

means for supplying said second red video signal to the base of said second transistor, wherein the voltage at the base of said second transistor is at a third voltage level when it is desired to illuminate said first dot in response to said second red video signal and is at a fourth voltage level, which is lower than said third voltage level, when it is not desired to illuminate said first dot in response to said second red video signal and wherein said third voltage level is higher than said first voltage level;

means for supplying the voltage at the emitter of said first transistor and said second transistor as the video signal to the red gun of said video display;

a third transistor;

a fourth transistor;

means for electrically connecting the emitter of said third transistor and said fourth transistor to ground through a second resistor;

means for electrically connecting the collector of said third transistor to the collector of said fourth transistor;

means for supplying said first blue video signal to the base of said third transistor, wherein the voltage at the base of said third transistor is at said first voltage level when it is desired to illuminate said first dot in response to said first blue video signal and is at said second voltage level when it is not desired to illuminate said first dot in response to said first blue video signal;

means for supplying said second blue video signal to the base of said fourth transistor, wherein the voltage at the base of said fourth transistor is at said third voltage level when it is desired to illuminate said first dot in response to said second blue video signal and is at said fourth voltage level when it is not desired to illuminate said first dot in response to said second blue video signal;

means for supplying the voltage at the emitter of said third transistor and said fourth transistor as the video signal to the blue gun of said video display;

a fifth transistor;

a sixth transistor;

means for electrically connecting the emitter of said fifth transistor and said sixth transistor to ground through a third resistor;

means for electrically connecting the collector of said fifth transistor to the collector of said sixth transistor;

means for supplying said first green video signal to the base of said fifth transistor, wherein the voltage at the base of said fifth transistor is at said first voltage level when it is desired to illuminate said first dot in response to said first green video signal and is at said second voltage level when it is not desired to illuminate said first dot in response to said first green video signal;

means for supplying said second green video signal to the base of said sixth transistor, wherein the voltage at the base of said sixth transistor is at said third voltage level when it is desired to illuminate said first dot in response to said second green video signal and is at said fourth voltage level when it is not desired to illuminate said first dot in response to said second green video signal; and means for supplying the voltage at the emitter of said fifth transistor and said sixth transistor as the video signal to the green gun of said video display.

4. A method for displaying information from first and second video signals on a video display comprising the steps of:

modulating the voltage at the base of a first transistor in response to said first video signal, wherein the voltage at the base of said first transistor is at a first voltage level when it is desired to illuminate a first dot on the screen of said video display in response to said first video signal and is at a second voltage level, which is lower than said first voltage level, when it is not desired to illuminate said first dot in response to said first video signal;

modulating the voltage at the base of a second transistor in response to said second video signal, wherein the voltage at the base of said second transistor is at a third voltage level when it is desired to illuminate said first dot in response to said second video signal and is at a fourth voltage level, which is lower than said third voltage level, when it is not desired to illuminate said first dot in response to said second video signal, wherein said third voltage level is higher than said first voltage level, wherein the emitters of said first and second transistors are electrically connected to ground through a first resistor and wherein the collectors of said first and second transistors are electrically connected; and suppying the voltage at the emitter of said first transistor and said second transistor as the video signal to said video display.

5. A method for displaying information from first and second video signals on a video display, said method comprising the steps of:

supplying said first video signal to the data input of a first flip-flop having a data input, a clock input, a Q output and a Q not output;

supplying said second video signal to the data input of a second flip-flop having a data input, a clock input, a Q output and a Q not output;

clocking said first flip-flop and said second flip-flop in response to the dot clock utilized to generate said first video signal and said second video signal;

supplying the Q output of said first flip-flop to a first input of an AND gate;

supplying the Q not output of said second flip-flop to a second input of said AND gate;

providing the output signal from said AND gate as a first input video signal to a first color generator;

providing the Q output from said second flip-flop as a second input video signal to a second color generator, wherein said first input video signal has a voltage level equal to said first video signal if said second video signal has a voltage level of essentially zero and has a voltage level of essentially zero if said second video signal has a positive voltage level, wherein said first color generator provides a first red video signal, a first blue video signal and a first green video signal in response to said first input video signal and wherein said second color generator provides a second red video signal, a second blue video signal and a second green video signal in reponse to said second input video signal;

modulating the voltage at the base of a first transistor in response to said first red video signal, wherein the voltage at the base of said first transistor is at a first voltage level when it is desired to illuminate a first dot on the screen of said video display in response to said first red video signal and is at a second voltage level, which is lower than said first voltage level, when it is not desired to illuminate said first dot in response to said first red video signal;

modulating the voltage at the base of a second transistor in response to said second red video signal, wherein the voltage at the base of said second transistor is at a third voltage level when it is desired to illuminate said first dot in response to said second red video signal and is at a fourth voltage level, which is lower than said third voltage level, when it is not desired to illuminate said first dot in response to said second red video signal, wherein said third voltage level is higher than said first voltage level, wherein the emitters of said first and second transistors are electrically connected to ground through a first resistor and wherein the collectors of said first and second transistors are electrically connected;

supplying the voltage at the emitter of said first transistor and said second transistor as the video signal to the red gun of said video display;

modulating the voltage at the base of a third transistor in response to said first blue video signal, wherein the voltage at the base of said third transistor is at said first voltage level when it is desired to illuminate said first dot in response to said first blue video signal and is at said second voltage level when it is not desired to illuminate said first dot in response to said first blue video signal;

modulating the voltage at the base of a fourth transistor in response to said second blue video signal, wherein the voltage at the base of said fourth transistor is at said third voltage level when it is desired to illuminate said first dot in response to said second blue video signal and is at said fourth voltage level when it is not desired to illuminate said first dot in response to said second blue video signal, wherein the emitters of said third and fourth transistors are electrically connected to ground through a second resistor and wherein the collectors of said third and fourth transistors are electrically connected;

supplying the voltage at the emitter of said third transistor and said fourth transistor as the video signal to the blue gun of said video display;

modulating the voltage at the base of a fifth transistor in response to said first green video signal, wherein the voltage at the base of said fifth transistor is at said first voltage level when it is desired to illuminate said first dot in response to said first green video signal and is at said second voltage level when it is not desired to illuminate said first dot in response to said first green video signal;

modulating the voltage at the base of a sixth transistor in response to said second green video signal, wherein the voltage at the base of said sixth transistor is at said third voltage level when it is desired to illuminate said first dot in response to said second green video signal and is at said fourth voltage level when it is not desired to illuminate said first dot in response to said second green video signal, wherein the emitters of said fifth and sixth transistors are connected to ground through a third resistor and wherein the collectors of said fifth and sixth transistors are electrically connected; and supplying the voltage at the emitter of said fifth transistor and said sixth transistor as the video signal to the green gun of said video display.

* * * * *